United States Patent [19]

Mitchell

[11] Patent Number: 4,919,037

[45] Date of Patent: Apr. 24, 1990

[54] CLIPBOARD BALLISTIC SHIELD

[75] Inventor: Hal D. Mitchell, Rolla, Mo.

[73] Assignee: American Protective Equipment, Inc., St. Louis, Mo.

[21] Appl. No.: 162,486

[22] Filed: Mar. 1, 1988

[51] Int. Cl.[5] ..... F41H 5/08

[52] U.S. Cl. ..... 89/36.05; D19/88; 109/49.5; 224/218; 224/914

[58] Field of Search ..... D19/88; 2/2.5, 16, 17, 2/20, 158; 89/36.05; 109/49.5; 24/3 A, 3 F, 67.11; 108/43; 190/100, 102, 900; 224/218, 901, 907, 914; 248/205.2, 444

[56] References Cited

U.S. PATENT DOCUMENTS

| | | | |
|---|---|---|---|
| 2,639,749 | 5/1953 | Lee | 2/158 |
| 3,766,865 | 10/1973 | Cutler | 89/36.05 |
| 3,848,547 | 11/1974 | Schaefer | 109/49.5 |
| 3,885,249 | 5/1975 | De Brabander | 2/158 |
| 3,958,276 | 5/1976 | Clausen | 2/2.5 |
| 4,287,607 | 9/1981 | Leach | 2/2.5 |
| 4,546,863 | 10/1985 | Kaufman | 89/36.05 |
| 4,767,093 | 8/1988 | Jones | D19/88 |
| 4,774,724 | 10/1988 | Sacks | 2/2.5 |

*Primary Examiner*—Stephen C. Bentley

[57] ABSTRACT

A writing surface, such as a clipboard, with a means to attach a lightweight package a ballistic material with facilities to handle as a writing surface which will stop the projectiles from small firearms at point blank range of under 1 foot. Said package can be used by a police officer for various writing responsibilities and can be quickly converted to use as a shield to block the use of a gun at close range.

7 Claims, 2 Drawing Sheets

CLIPBOARD BALLISTIC SHIELD

BACKGROUND OF THE INVENTION

Many police officers have been shot and killed or wounded while stopping cars on a routine traffic violation or the like. Some officers do not wear their ballistic vests because of the discomfort caused by them for a complete shift of work. As a practical matter, the officer does not need the protection most of the time and this fact causes many officers to take the chance and leave the ballistic vest behind.

The clipboard ballistic shield of this invention can be used at those moments of greatest danger and be set aside when that threat is gone. The clipboard shield is also an added measure of protection to the officer who elects to wear his ballistic vest because of its' great flexibility of use.

It is the embodiment of this invention that the combination of protective elements are brought together which will provide protection from a gunshot threat.

The nature of the ballistic materials are such that the numbers of the basic components may be increased to provide protection up to and including level IIIA, National Institute of Justice, N12 standard 0108.01, ballistic resistant protective materials as is desired by the officer or official; which level includes high powered 44 magnum pistol and 9 mm sub-machine gun bullets with full metal jacket.

OBJECTS OF THE INVENTION

An objective of the invention is to provide a high quality ballistic protection which can be thrust into the muzzle of a gun at close range to shield the potential victim by stopping direct shots and by causing the assailant to fire at an angle which will cause the bullet to miss the victim because of the close proximity of the shield to the gun. A further objective of the invention is to provide a shield with the further utility of a writing board with handle means for handling and holding some fashion of clipboard means for fixing writing materials in place while writing.

Still another objective of the invention is to provide said protection in a package which is manageable in tems of bulk and weight.

Yet another objective of the invention is to provide a soft armor which will catch a firearm projectile rather than allow the round to ricochet off to do damage somewhere else.

A final objective of the invention is to produce a ballistics protective system the principles of which can be adopted to meet the needs for protecting against various ballistic threats as well as knife, ice pick, threats to the officer which might occur in domestic disturbances.

A brief description of the drawings for the preferred embodiment of the invention.

DETAILED DESCRIPTION OF THE DRAWINGS

Figure 1:
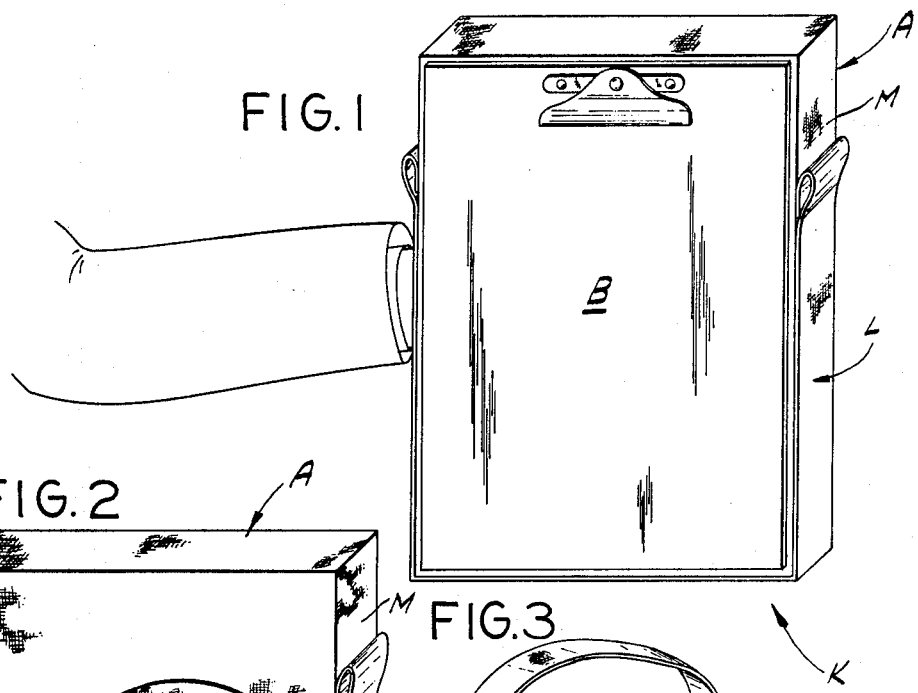
FIG. 1 Shows the ballistic shield being held to facilitate writing for a right handed person with the shoulder strap wrapped on the package.
Figure 2:
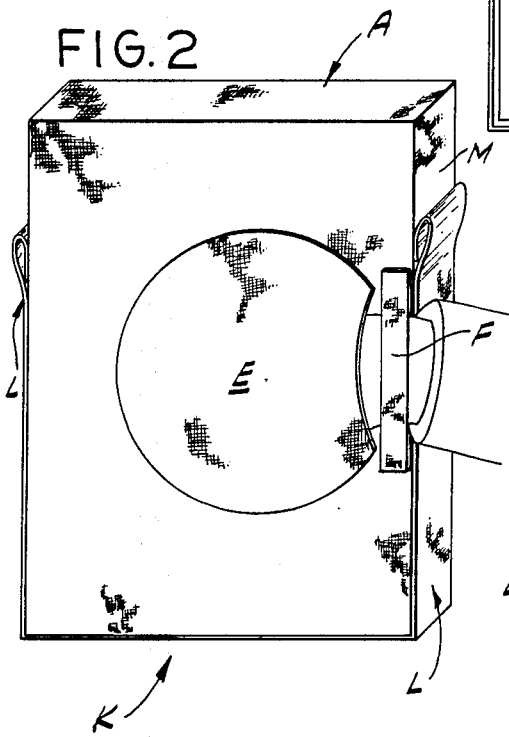
FIG. 2 Shows the circular packet and wrist strap on the ballistic shield on side opposite the VELCRO hook and loop fasteners arranged to interface the attachment of said clipboard to the ballistic package and showing shoulder strap deployed.

The invention is shown in FIG. 1 with clipboard B attached to the ballistic package, sewn bag cover A, and the two components being together to form the combination writing surface and ballistic shield of the invention. FIG. 2 shows the utility of the invention from the opposite side from the clipboard B where the universal pocket E of circular shape and F is the wrist strap and said strap F and pocket E are located in the middle of sewn bag cover A so as to allow it to be reversed to facilitate its' use by a person writing with the opposite hand. FIG. 2 shows the shield A to be held palm down with the left hand inserted.

Figure 3:
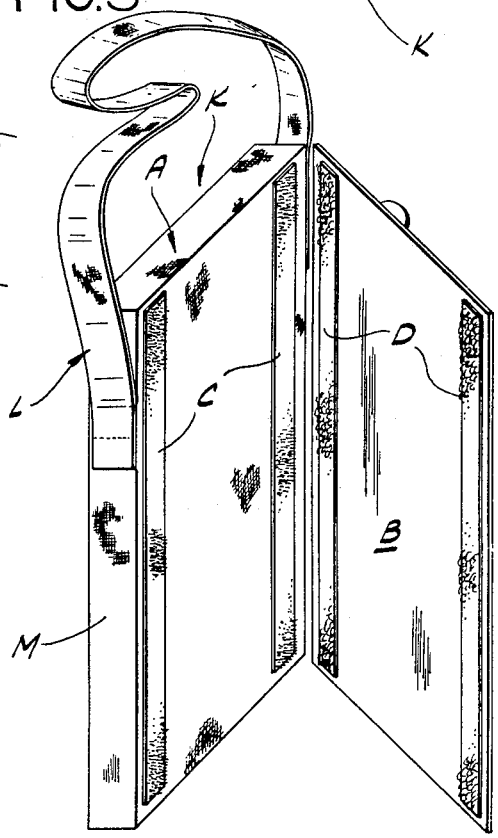
FIG. 3 Is a view of the clipboard and the ballistic package cover showing the placement of the VELCRO hook and loop to interface and with the shoulder strap deployed.
Figure 4:
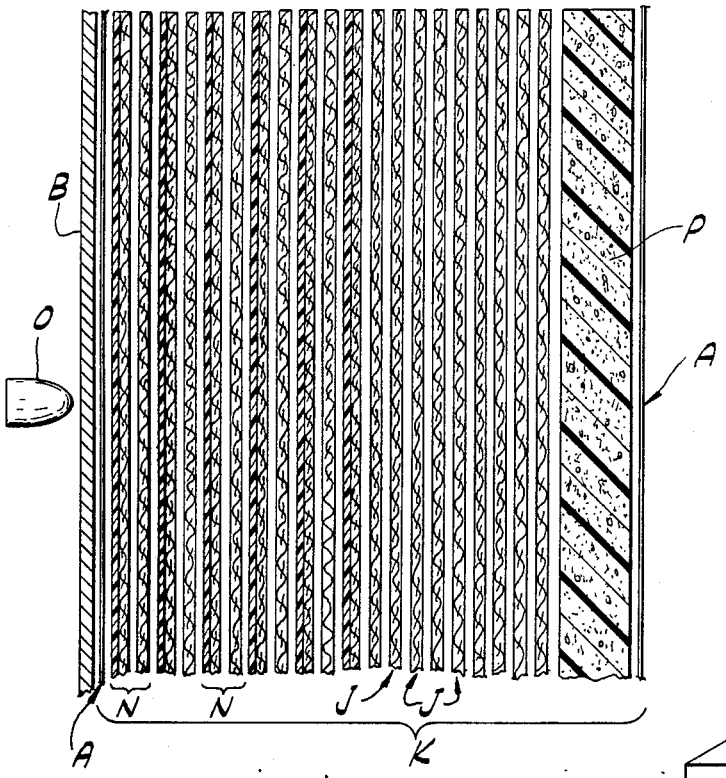
FIG. 4 Shows a cross section of an enlarged view of the embodiment of the invention in a typical application.
Figure 5:
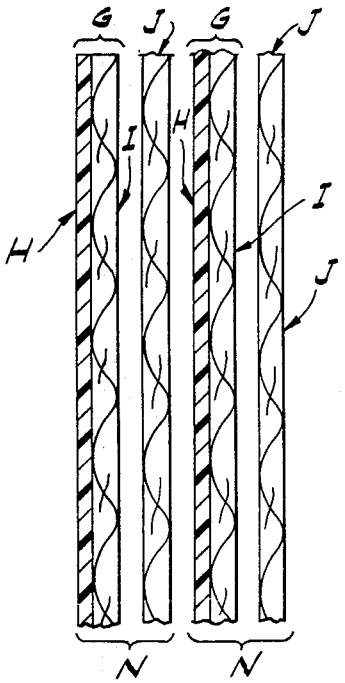
FIG. 5 Shows a view of the coated fabric component part and the plain fabric component part adjacent to each other to form a cell or unit.

The VELCRO hook D is attached to the clipboard B as shown in FIG. 3 with the loop portion C being sewn to the sewn bag retainer A and said bag retainer A for the ballistic package being sewn in the form of a box or rectangular solid to receive the remainder of the ballistic package shown in FIG. 4. The placement of the VELCRO C and D in FIG. 3 facilitates the means for the clipboard to be reversible with respect to the sewn bag to facilitate the function of the universal packet E so the users can be both right and left handed.

FIG. 4 is a cross section of the embodiment of the ballistic shield of the invention so that a bullet O striking the ballistic shield at the arrow would first contact the masonite metal or plastic of the clipboard B. Since it is not necessary that the clipboard B or some other writing surface which could be joined to the ballistics package K be a ballistic material or have a special ballistic function, it is expected that the bullet O will pass through the writing surface without particular incident. The ballistic package K of the invention will perform its task without the clipboard or other like surface in place.

The bullet O will next, normally, hit the first layer of the ballistic package or sewn cloth retainer means A. It is also possible that the bullet O could hit the hook and loop fastener means C and D if they were properly placed. This will have no affect on the bullets penetration for the function of the fasteners are merely to hold the clipboard B component to the sewn cloth bag A which is the container part of the ballistic package. The bullet O will also pass through the cloth bag A and strike the coated fabric component part G comprising one layer of hot melt H and being attached to one layer of 1000 denier poly aramid fiber fabric I. The hot melt coating H is melted by the heat created by the stress of the impact and this hot melt H then coats the bullet to make it sticky which increases the bullets resistance to the penetration of the fabric portion I of the coated fabric component G and the adjacent uncoated fabric J. Each part, I and J, comprising one layer of 1000 denier aramid fiber fabric like KEVLAR style 713. The fabric layer of the coated fabric component I of the first unit N may or may not be penetrated by the bullet O depending on the mass, velocity, material, and bullet nose shape. Some slower bullets such as 38 and 45 caliber rounds may not completely penetrate the first coated fabric component part G of the first N unit. If the bullet passes through the plain fabric component part J, it will be wiped somewhat of the sticky hot melt material. The bullet O will then strike the next hot melt adhesive layer H of the 2nd unit N and so on through the units until the bullet O is finally stopped. As many unit N as necessary can be used to do the task as required, however, in this particular application of protection device as shown in the drawings, it has been demonstrated through testing that six (6) units N of coated fabric component G and uncoated fabric component J and nine additional uncoated fabric component J are sufficient for this application. These 6 units N and nine layers J in conjunction with the material shown in FIG. 6 as energy absorbing ionomer foam P, FIG. 6, together with the cloth cover means A work together to comprise the ballistic package K and with the clipboard shield B attached with hook and loop fasteners then comprising the ballistic shield of the invention.

Imperical testing has shown that the 6 units N are sufficient to stop most standard hand guns with a margin of safety for even more powerful and rarely seen weapons. However, if additional layers or arrangement within cells are necessary, it can be accomplished by adding more units.

Twenty-two (22) caliber, 38, and 38 special are stopped in the first and second layers. Three fifty-seven (.357) magnum, 41 magnum, 38 special, and 9 mm hollow points in the third to fifth layers and the 9 mm ball ammunition GECO round and 44 magnum are stopped in the fabric layers just following the last layer of the coated fabric I.

There is an additional strap carrying means L which orginates in the side M of the sewn cloth cover retainer means A and strap means L is of a length to surround either half of the bag means A so as to be snug to M and if deployed as in FIG. 3 can be used as a neck strap or a shoulder strap to carry and display the ballistic shield in an alternative manner.

Figure 6:
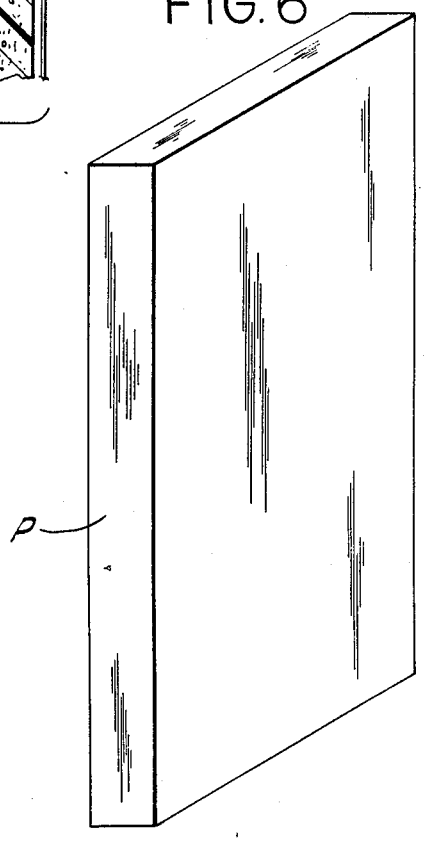
FIG. 6 Shows a view of energy attenuating pad means.

The energy absorbing foam G of FIG. 6 is very important to the invention. The material can be a four (4) pound density ionomer foam as SURLIN ionomer foam by Dupont or any other similar material. The foam gives the package F form and handability while it is compressed locally behind the bullet stripe to act to reduce the stress and absorb the blunt trauma of the bullet impact.

What I claim is:

1. The combination of a clipboard and a ballistic package having a first bullet strike face, a second face and four sides, two of said sides being opposing, comprising:

hook and loop fastener means attaching said clipboard to the first face of said ballistic package;

a handling device located on the second face of said ballistic package, and handling device comprising a wrist strap and circular pocket to accept either the right or left hand of a person handling said combination clipboard and ballistic package, said ballistic package including a fabric layer of woven nylon impregnated with urethane and a layer of ionomer foam; and deployable strap means attached to said two opposing sides of said four sides, said deploying strap means fitting snugly at least three of said four sides when not deployed and being deployable into first position to engage the neck and a second position to engage the shoulder of a person using said combination clipboard and ballistic device.

2. The combination of claim 1, wherein said ballistic package further has an outermost portion comprising a sewn container means, said sewn container means comprising said fabric layer of woven nylon impregnated with urethane.

3. The combination of claim 1, wherein said ballistic package further includes a first layered portion comprising: sheets of tightly woven ballistic fabric with a coating of heat activated adhesive applied to the bullet strike face of said fabric and being used alternatively with uncoated, tightly woven ballistic fabric, one piece of said uncoated fabric comprising one layer and said layers being used in multiples to form the layered portion.

4. The combination of claim 1, wherein said ballistic packages further includes a first layered portion comprising: sheets of tightly woven ballistic fabric with a coating of hot, heat activated adhesive applied to said bullet strike face and each sheet comprising of a layer and used in multiples to form the layered portion.

5. The combination of claim 1, wherein said ballistic package further includes a layered portion comprising: multiple sheets of tightly woven ballistic fabric means.

6. The combination of claim 1, wherein said layer of ionomer foam comprises a bullet strike cushion and energy absorbing pad.

7. The combination of claim 1, wherein said ballistic package is arranged in an order from said first bullet strike face of: first, a hot melt coated, tightly woven ballistic fabric layered portion; second, a tightly woven ballistic fabric layered portion, and third, a bullet strike cushion and energy absorbing padding means said layer of ionomer foam.

* * * * *